US008291842B2

(12) United States Patent
Dangtran et al.

(10) Patent No.: US 8,291,842 B2
(45) Date of Patent: Oct. 23, 2012

(54) METHODS FOR INCINERATING SLUDGE IN A COMBUSTOR

(75) Inventors: Ky Dangtran, Richmond, VA (US); Robert F. Kelly, Chesterfield, VA (US)

(73) Assignee: Infilco Degremont, Inc, Richmond, VA (US)

( * ) Notice: Subject to any disclaimer, the term of this patent is extended or adjusted under 35 U.S.C. 154(b) by 35 days.

(21) Appl. No.: 12/838,929

(22) Filed: Jul. 19, 2010

(65) Prior Publication Data

US 2010/0282139 A1 Nov. 11, 2010

Related U.S. Application Data

(62) Division of application No. 12/012,286, filed on Feb. 1, 2008.

(60) Provisional application No. 60/899,617, filed on Feb. 2, 2007.

(51) Int. Cl.

| | |
|---|---|
| ***F23N 1/08*** | (2006.01) |
| ***F23N 5/00*** | (2006.01) |
| ***F23G 5/04*** | (2006.01) |
| ***F23G 5/30*** | (2006.01) |

(52) U.S. Cl. ..... 110/186; 110/101 CA; 110/245; 110/190; 110/221

(58) Field of Classification Search ..... 110/245, 110/101 CA, 186, 187, 190, 221, 235
See application file for complete search history.

(56) References Cited

U.S. PATENT DOCUMENTS

| | | | | |
|---|---|---|---|---|
| 3,319,586 | A * | 5/1967 | Albertson et al. | 110/342 |
| 4,395,958 | A * | 8/1983 | Caffyn et al. | 110/246 |
| 4,917,027 | A * | 4/1990 | Albertson et al. | 110/346 |
| 5,189,963 | A * | 3/1993 | Mann | 110/190 |
| 5,279,637 | A * | 1/1994 | Lynam et al. | 71/12 |
| 5,744,037 | A * | 4/1998 | Fujimura et al. | 110/245 |
| 6,279,493 | B1 * | 8/2001 | Beaumont et al. | 110/346 |
| 6,692,642 | B2 * | 2/2004 | Josse et al. | 210/605 |
| 7,250,302 | B2 * | 7/2007 | Bernhardsson et al. | 436/49 |
| 2001/0011438 | A1 | 8/2001 | Fujimura et al. | |

* cited by examiner

*Primary Examiner* — Kenneth Rinehart
*Assistant Examiner* — David J Laux
(74) *Attorney, Agent, or Firm* — Landmark Intellectual Property Law PC

(57) ABSTRACT

A method controls mass and heat loading of sludge feed into a fluidized bed combustor (FBC) controlled via regulation of a polymer dosage or a sludge feed rate including: continuously monitoring at least one performance characteristic of the FBC; producing an input signal characteristic; analyzing the input signal and determining a first rate of change of the characteristic; generating an output signal based on the first rate of change to control addition of polymer to the FBC; generating a second output signal to control addition of sludge feed to the FBC; and determining a transition point between the addition of polymer and addition of sludge, which transition point is an upper limit of a first rate change to maintain flow so that the value of the characteristic is maintained proximate at the upper limit.

6 Claims, 4 Drawing Sheets

METHODS FOR INCINERATING SLUDGE IN A COMBUSTOR

RELATED APPLICATIONS

This application is a divisional of U.S. application Ser. No. 12/012,286, filed Feb. 1, 2008, which claims priority of U.S. Provisional Application No. 60/899,617, filed Feb. 2, 2007, the contents of both of which are herein incorporated by reference.

TECHNICAL FIELD

This disclosure relates to methods for incinerating sludge in a combustor, particularly to efficiently disposing of sludge generated from wastewater treatment facilities or the like by incineration in fluidized bed combustors (FBC).

BACKGROUND

Incineration of sewage sludge continues to gain more widespread acceptance as a viable treatment strategy to address waste solids generated from wastewater treatment plant operations. A significant number of systems are commercially available and multiple installations exist globally.

Conventional designs for an FBC system such as that shown in FIG. 1, typically utilizes dewatered wastewater solids, produced by a dewatering equipment such as centrifugation or belt filter press located immediately upstream, as a principle fuel source. In some cases, dewatered wastewater solids from multiple remote locations are brought on-site to a central FBC facility and blended to create a homogenous fuel source for the FBC operations.

Additionally, conventional FBC designs utilize intermittent injection of an auxiliary fuel source such as fuel oil or natural gas to minimize sporadic combustion associated with inconsistent sludge feed quality and assist with controlling bed temperature at a level that is above the ignition temperature of the selected auxiliary fuel and feed sludge. When fuel oil is used as the auxiliary fuel source the resulting bed temperature typically ranges from 1200° F. to 1300° F. and when natural gas is utilized the corresponding bed temperature typically ranges from 1300° F. to 1400° F.

At a constant combustion air flow rate, operation of FBC systems is influenced by a number of variable process parameters, several of which are related to the sewage sludge feed including its mass loading and physical/chemical characteristics such as the solids content, volatile content and calorific heating value.

Incineration performance varies in function with the quality of the wastewater solids fuel source. It is generally believed that the quality and consistency of the wastewater solids feed stream is the primary factor in determining the performance of an FBC system.

Specifically, it is well understood that the temperature difference between the freeboard and bed temperatures, referred to herein as $\Delta T$, varies as a function of the sewage sludge quality. $\Delta T$ is known to increase as the solids content of the sewage sludge decreases. AT is also an indicator of the degree of over-bed burning, with excessive $\Delta T$ values indicating that the level of over-bed burning is too high and, therefore, both limiting plant capacity and increasing emission of pollutants such as CO, organics and $NO_x$ compounds.

Fluctuations in sewage sludge quality or loading rate are regular occurrences that result in process "hiccups" or performance excursions and the need for corrective measures such as addition of auxiliary fuel and activation of quench water sprays within the freeboard. Such corrective measures ultimately reduce process capacity and increase operating costs.

Typically, FBC systems are set to maintain a freeboard temperature between 1500 and 1600° F. Quench water sprays, which are generally activated in sequence beginning with initiation of the first spray at 1600° F., are used to prevent exhaust gas temperature excursions and protect downstream equipment such as heat exchangers or waste heat boilers.

To address the regular fluctuation in sewage sludge feed quality, the FBC is typically designed to handle a range of wastewater solids characteristics, frequently resulting in an FBC reactor that is oversized for typical operations and requiring use of auxiliary fuel sources to reach optimal operating temperature, therefore increasing both capital and operating costs.

Efficient operation of an FBC system employs a consistent sewage sludge feed supply to optimize process performance. Therefore, to develop a more efficient and cost effective incineration system, there exists a need to regulate the mass and heat loadings of wastewater solids to the FBC.

SUMMARY

We provide methods of incinerating sludge in combustors including establishing at least one target performance characteristic of a combustor; introducing the sludge into the combustor as a primary fuel; monitoring at least one performance parameter of the combustor; calculating an actual performance characteristic based on the performance parameter; and adjusting the quantity and/or quality of fuel introduced into the combustor in response to a monitored performance characteristic to substantially maintain the target performance characteristic.

We also provide an apparatus for incinerating sludge including a combustor adapted to receive sludge as fuel and incinerate the sludge; a sensor that monitors at least one performance parameter of the combustor; and a controller connected to the combustor and the sensor that 1) establishes at least one target performance characteristic of the combustor, 2) calculates an actual performance characteristic based on the performance parameter and 3) adjusts the quantity and/or quality of fuel introduced into the combustor in response to a monitored performance characteristic to substantially maintain the target performance characteristic.

We further provide a method of controlling mass and heat loading of sewage sludge feed into a fluidized bed combustor controlled via regulation of a polymer dosage or a sewage sludge feed rate including continuously monitoring at least one performance characteristic of the FBC; producing an input signal characteristic; analyzing the input signal and determining a first rate of change of the characteristic; generating an output signal based on the first rate of change to control addition of polymer to the FBC; generating a second output signal to control addition of sewage sludge feed, to the FBC; and determining a transition point between the addition of polymer and addition of sewage sludge; which transition point is an upper limit of a first rate change to maintain flow so that the value of the characteristic is maintained proximate the upper limit.

We further yet provide a method of controlling mass and heat loading of sludge feed into a thermal dryer controlled via regulation of a polymer dosage or a sludge feed rate including continuously monitoring at least one performance characteristic of the thermal dryer; producing an input signal characteristic; analyzing the input signal and determining a first rate of change of the characteristic; generating an output signal based on the first rate of change to control addition of polymer to the thermal dryer; generating a second output signal to control addition of sludge feed to the thermal dryer; and determining a transition point between the addition of polymer and addition of sludge, which transition point is an upper limit of a first rate change to maintain flow so that the value of the characteristic is maintained proximate at the upper limit.

BRIEF DESCRIPTION OF THE DRAWINGS

The drawings show selected, representative aspects of structure, systems and process that are presently preferred, it being understood that this disclosure is not limited to the precise arrangements and instrumentalities shown.

DETAILED DESCRIPTION

Figure 1:
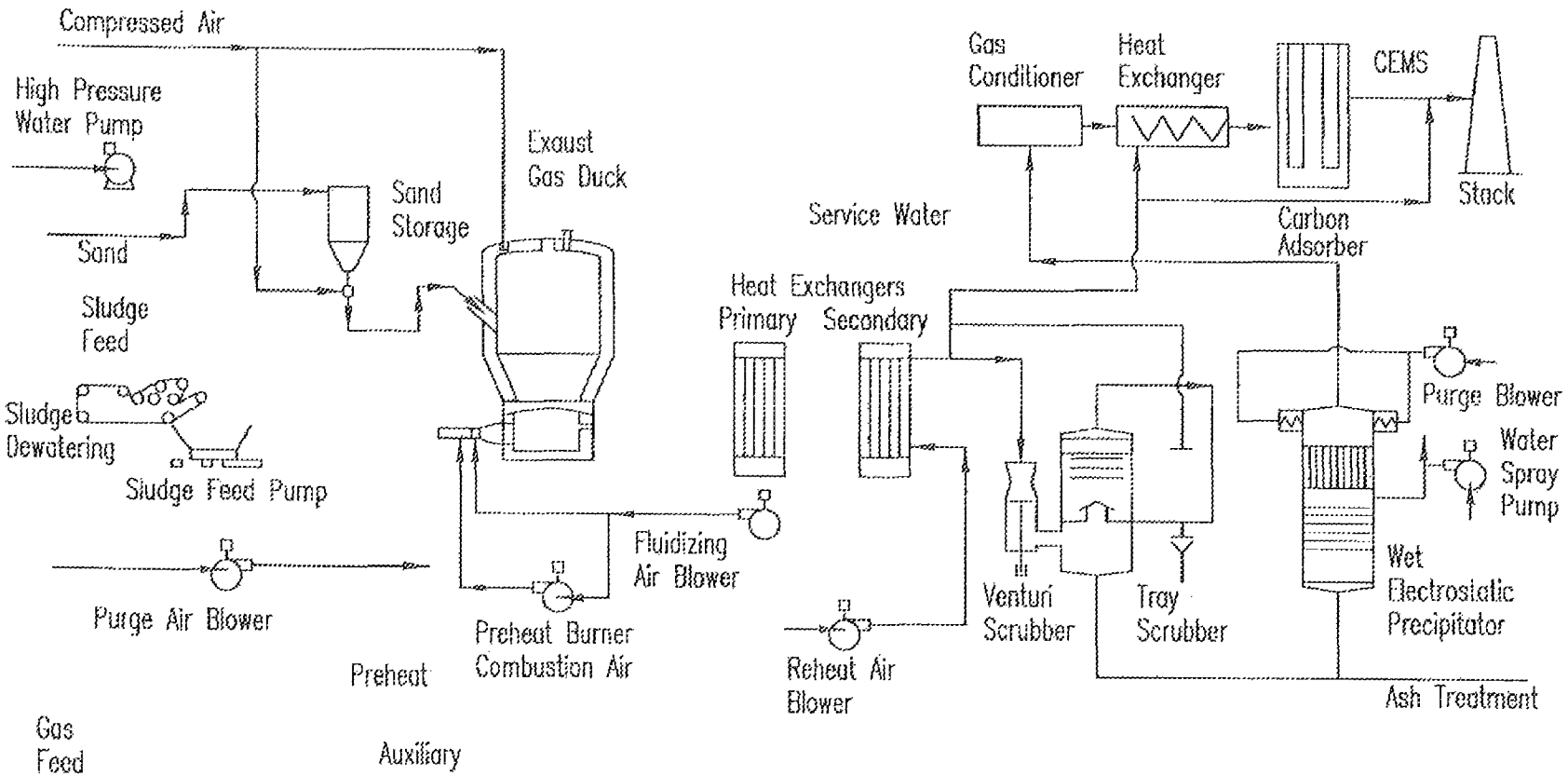
FIG. 1 is a schematic view of a conventional FBC process flow diagram.

It will be appreciated that the following description is intended to refer to specific aspects of the disclosure selected for illustration in the drawings and is not intended to define or limit the disclosure, other than in the appended claims.

This disclosure relates to FBC systems, thermal dryers and automated controllers and methodology, whereby key incineration performance parameters, preferably the bed and freeboard temperatures and corresponding ΔT are used to regulate the mass and quality of sludge feed to the incinerator/dryer through control of the upstream dewatering technology and/or wastewater solids blending operations. The sludge can be any number of types of sludge such as that generated in a wastewater treatment process, sludge that is agricultural waste such as manure from cattle and hog farming, or the like.

We have found incinerator operation may be regulated through automated control of the upstream dewatering or thickening unit processes based upon generation of feedback signals derived from monitoring key incinerator/dryer parameters, ultimately to achieve a stable and controlled throughput of wastewater solids of a targeted quality.

This controlled feed of sludge to FBC systems/thermal dryers, in terms of both the dry solids content and the rate of feed yields more stable operating conditions within the FBC/dryer, ultimately resulting in performance that is more efficient, less costly and safer.

Thus, we provide controllers and methodologies for inclusion in FBC systems and thermal dryers used for disposal/treatment of sludge and, in particular, to automated controllers that regulate the mass flow and the quality of the influent sludge based upon incineration/drying performance parameters and, therefore, results in an incineration/drying process having greater performance efficiency and that is more economical to operate. Implementation of the controllers described herein provides for increased FBC system/thermal dryer capacity while lowering the consumption of auxiliary fuels and reducing emissions of air pollutants such as carbon monoxide (CO) and nitrogen oxide ($NO_x$) compounds.

Turning to the drawings, FIG. 1 illustrates the overall design of a typical, conventional FBC facility and the many variables that may affect process performance.

Figure 2:
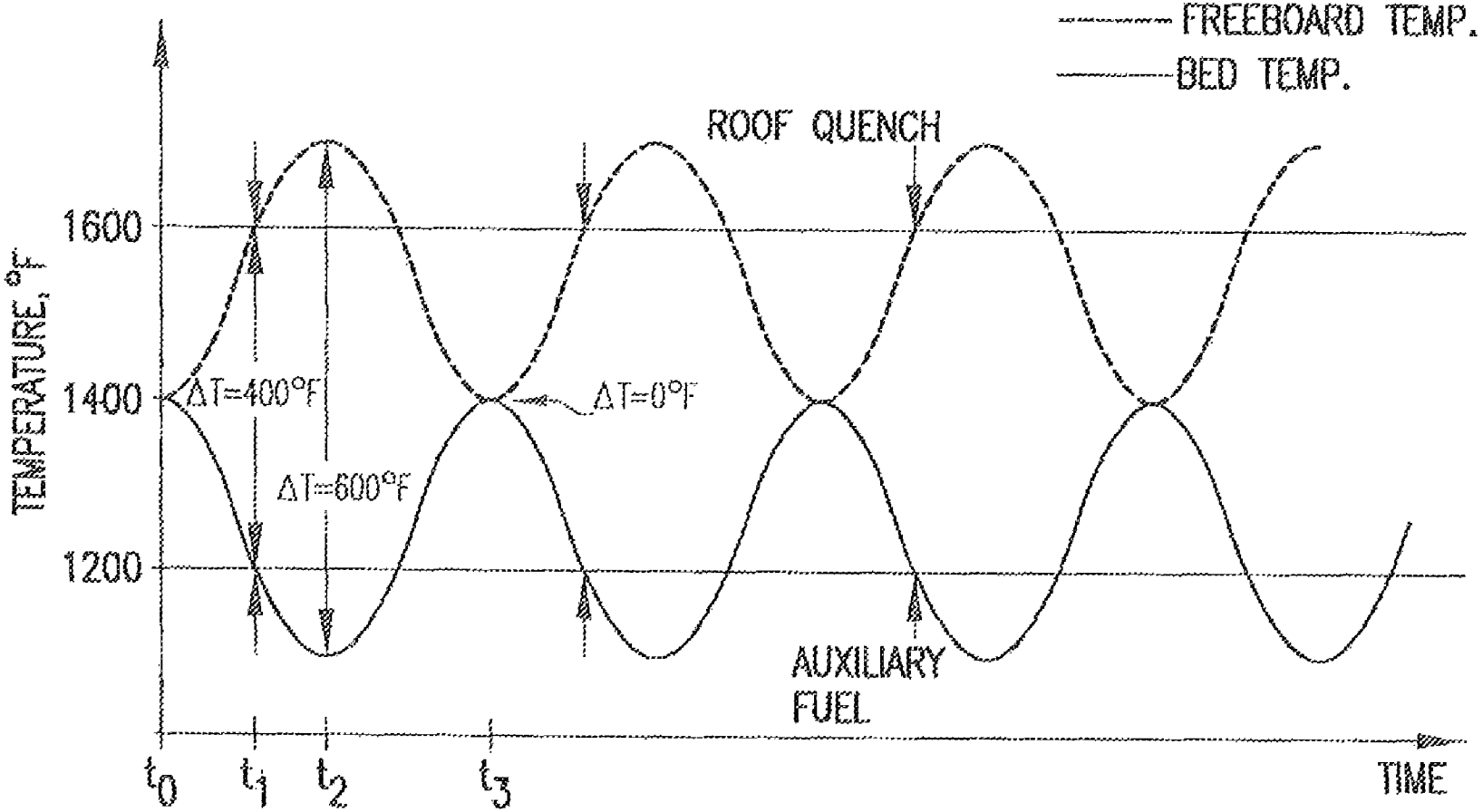
FIG. 2 is a graph of variations in bed and freeboard temperatures as a function of time and regular fluctuation in the wastewater solids feed characteristics taken from an FBC such as that shown in FIG. 1.

FIG. 2 illustrates regular, wide swings in bed temperature and the corresponding effect on freeboard temperature in response to the changing sewage sludge feed characteristics typically found when polymer or conditioning agent dosage is controlled according to conventional methodology. When sewage sludge feed to the FBC is not controlled, auxiliary fuel is injected into the bed simultaneously with quench water spray in the freeboard as shown at time $t_1$.

FIG. 2 also illustrates the ΔT value, with ΔT increasing as the wastewater solids content decreases. It can be seen that ΔT is equal to 400° F. at time $t_1$, before activation of a first quench spray or injection of auxiliary fuel. AT can reach its maximum of 600° F. at time $t_2$ if the roof spray system is not capable of lowering the freeboard temperature. AT decreases as the bed temperature increases and is at 0° F., its lowest value, at time $t_3$. Such large ΔT's result in serious operational inefficiencies.

Figure 3:
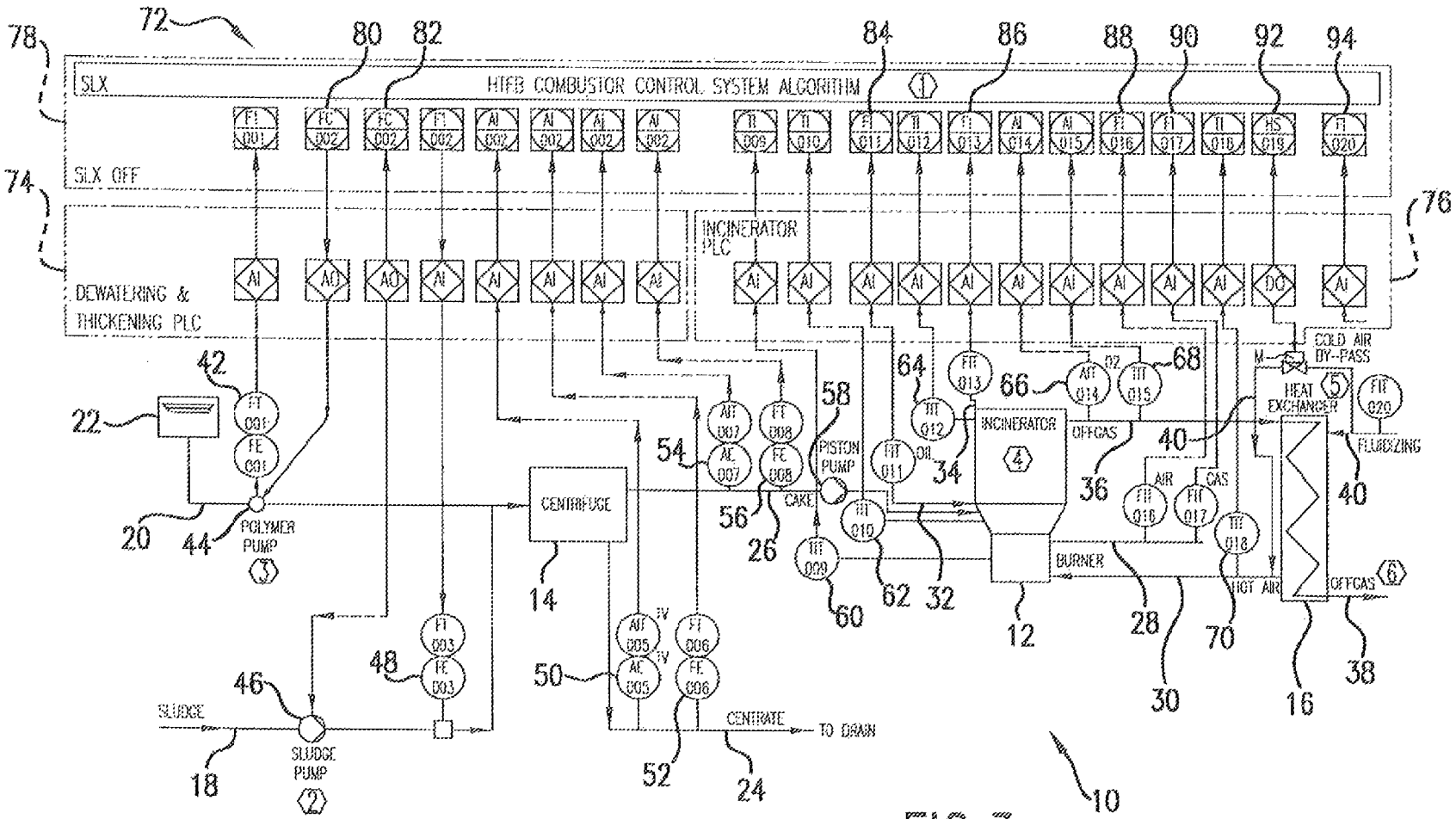
FIG. 3 is a schematic view of an automated control system illustrating representative components.

FIG. 3 shows a control system including thickening or dewatering equipment, a conditioning chemical feed system, a wastewater solids feed system, various sensor technologies and an FBC with associated heat exchange and fluidizing air systems. It should be understood that FBC systems are illustrated for convenience. Thermal dryers may be substituted for such combustors depending on the desired application.

In particular, FIG. 3 shows a system 10 that incinerates sludge, preferably sewage sludge generated in wastewater treatment facilities, for example. The system 10 includes a fluidized bed combustor (FBC) 12, a dewatering system that is in this instance in the form of a centrifuge 4 upstream of FBC 12 and a heat exchanger 16 located downstream of FBC 12. Any number of FBC 12 type devices are known in the art and may be employed by one skilled in the art. Also, there are any number of dewatering devices that are suitable for use in conjunction with the methodology and other apparatus described herein. For example, other dewatering devices include but are not limited to dewatering belts, plate and frame presses, screw presses and vacuum presses. Other types of dewatering technology known in the art may also be used. Similarly, there are any number of heat exchanger devices known in the art that may be substituted for heat exchanger 16 as shown in FIG. 3.

There are additional components that feed the various components 12, 14 and 16 including a sludge line 18 that introduces sludge to centrifuge 14. There is also a polymer line 20 connected to a polymer source 22 that feeds polymer to centrifuge 14. On the downstream side, centrifuge 14 has a centrate line 24 that channels centrate to another disposal means (not shown). There is also a cake line 26 that transports dewatered sludge, typically in the form of a so-called "cake," to FBC 12.

There are additional lines that supply other materials to FBC 12. For example, FBC receives auxiliary air and auxiliary fuel gas from air/fuel line 28. Heated air is also received from heat exchanger line 30. FBC 12 also connects to fuel oil line 32 as well as quench spray water flow line 34. Various materials are introduced into FBC 12 through those lines which will further be described below.

On the other hand, FBC 12 outputs off gas through of gas line 36. Of gas line 36 connects to heat exchanger 16 and ultimately discharges off gas through line 38. Heat exchanger 16 receives fluidizing air through fluidizing air line 40 which also bypasses heat exchanger 16 by way of bypass line 40 with connects to heat exchanger line 30.

The system 10 also includes a number of sensors that are positioned in/at various of the connecting lines and apparatus.

For example, moving generally from left to right in FIG. 3, there is a polymer feed rate detector 42. The polymer feed rate is determined by a polymer pump 44. Sludge pump 46 controls the flow of sludge toward centrifuge 14. There is a sludge flow rate detector 48 that determines the rate of flow of sludge passing through sludge line 18.

There is a sensor 50 downstream of centrifuge 14, that determines the percentage of solids flowing through centrate line 24. Also, the centrate flow rate is measured by centrate flow rate detector 52. Then, there is a detector 54 that determines the percentage of cake solids in the material flowing through cake line 26. Similarly, there is sludge flow rate detector 56. A sludge pump 58 controls the passage of cake from centrifuge 14 to combustor 12.

Combustor 12 is associated with a number of sensors/detectors. For example, there is a wind box temperature sensor 60 connected to the lower portion of combustor 12. There is also a bed temperature sensor 62 associated with the combustor proximate the fluidized bed. The upper portion of combustor 12 also has a freeboard temperature sensor 64.

Downstream of combustor 12 is an oxygen sensor 66 that detects the oxygen content in the off gas in off gas line 36. There is also an off gas temperature sensor 68 to determine the temperature of the off gases in off gas line 36.

There is a temperature sensor 70 in connection with the heat exchanger 16, that detects the temperature of air exiting heat exchanger 16.

The various sensors/detectors, as well as control pumps, may connect to controller 72. Controller 72 may be formed from an upstream module 74 and a combustor/downstream module 76. Both modules 74 and 76 connect to the overall system control module 78 as shown in FIG. 3.

Module 78, starting generally from the left and moving to the right, includes a polymer flow controller 80 that connects to polymer pump 44 and operates in conjunction with the polymer feed rate detector 42. Similarly, sludge pump flow controller 82 connects to sludge pump 46 to control the rate of flow of sludge through sludge line 18. This works in conjunction with detector 48.

Downstream of centrifuge 14, the detectors 50 and 52 also channel through module 74 into module 78 from centrate line 24. Similarly, detectors 54 and 56 that are associated with cake line 26 are connected through module 74 and into module 78.

Sensors 60, 62 and 64 connect through module 76 and into module 78. There is also an auxiliary fuel oil flow controller 84 that controls the flow of auxiliary/supplemental fuel oil into combustor 12. There further is a controller 86 for the quench spray water flow into the upper portion by way of quench spray water line 34 into the upper portion of combustor 12.

Then, downstream of combustor 12, sensors 66 and 68 connect through module 76 to module 78. Also, there is an auxiliary air flow controller 88 that connects to line 28 to control the flow of auxiliary air into the lower portion of combustor 12. Similarly, there is auxiliary fuel gas flow controller 90 connected to line 28 to control the introduction of auxiliary fuel into combustor 12. Finally, a heat exchanger air sensor 70 connects through module 76 into module 78.

With respect to heat exchanger 16, there is a cold air bypass valve controller 92 that permits the flow of fluidizing air from fluidizing air line 40 to bypass, either in part or in whole, around heat exchanger 16 and into air line 30 to be supplied to combustor 12. Finally, there is a fluidizing air flow controller 94 that determines the flow of fluidizing air into heat exchanger 16 through fluidizing air line 40.

Figure 4:
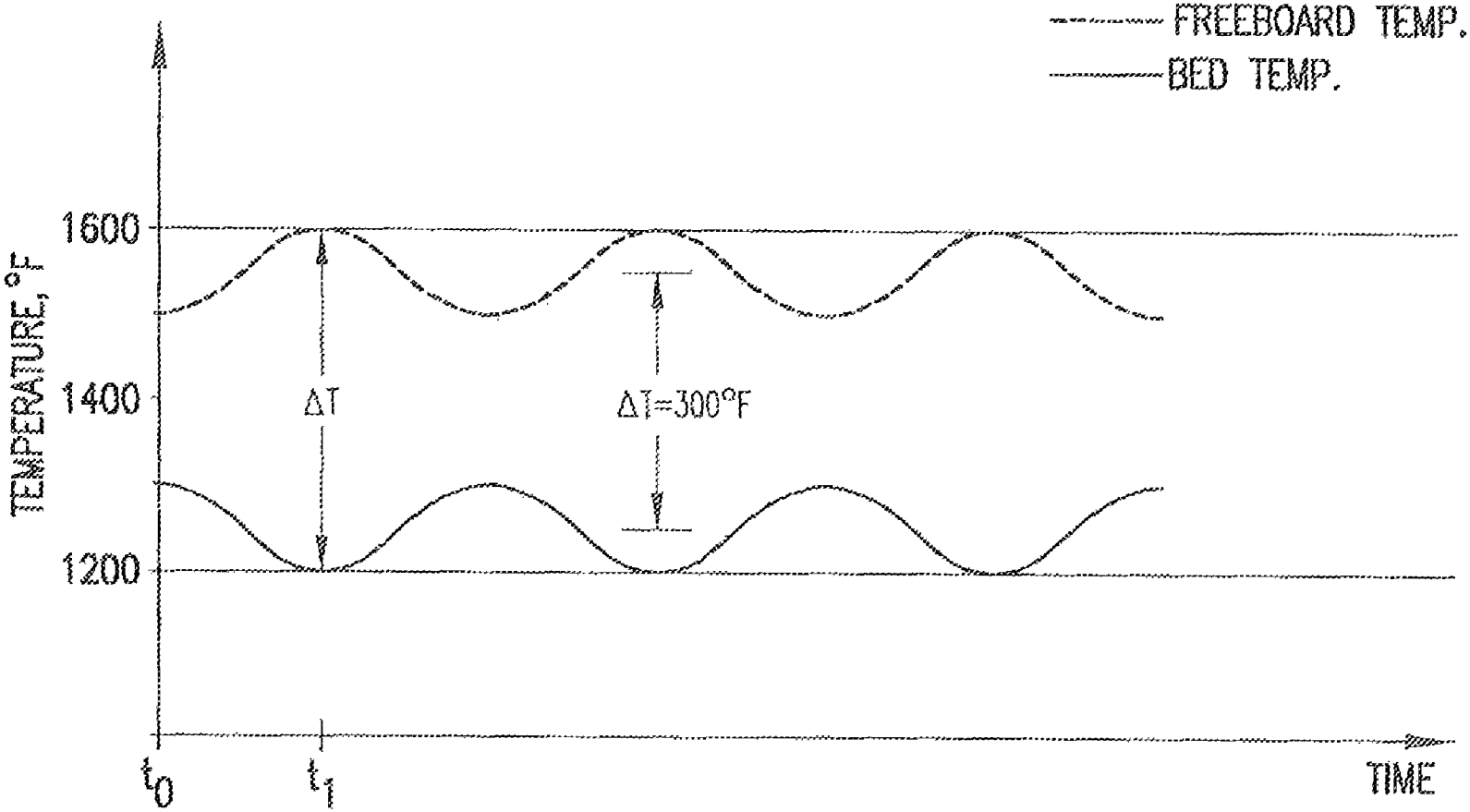
FIG. 4 is a graph illustrating the effect of regulating wastewater solids feed to FBC systems using a control protocol and the resulting stability provided to the incinerator bed and freeboard temperatures.

FIG. 4 shows that implementation, of the control system shown in FIG. 3 provides a steady sewage sludge feed to the FBC, for example, through regulation of polymer dosage, resulting in a flattening of the $\Delta T$ around the intermediate value of 300° F. as the bed and freeboard temperatures are maintained within their optimum ranges. This is compared to prior systems such as shown in the graph of FIG. 2 wherein $\Delta T$ is 600° F. In other words, $\Delta T$ is reduced by about 50%.

The system 10 of FIG. 3 may operate in a number of ways and in accordance with various methodologies. One preferred method of operation provides multiple levels of so-called "responses" that provide for the excellent performance shown in FIG. 4 relative to that of the conventional methodology as demonstrated in FIG. 2. Thus, the methodology focuses primarily on the substantially real time or "online" monitoring of bed and freeboard temperatures as detected by sensors 62 and 64, respectively. Monitoring bed and freeboard temperatures results in a substantially continuous and ongoing calculation of $\Delta T$. A $\Delta T$ of greater than a selected amount such as, for example, about 300° F. can be determined as being a "poor" performance. Upon detecting such "poor" performance, the system automatically engages in selected levels of response.

For example, a first level of response may be an adjustment of cold air bypass to change the temperature of preheat air entering combustor 12. If the temperature is trending towards being too hot, for example, there is a rising bed temperature in combustor 12, and an increase in the cold air bypass lowers the temperature of the preheated air. On the other hand, if the incoming sludge has too high of a moisture content and the bed temperature is decreasing, then the controller 72 may decrease the amount of cold air bypass through controller 92 so that the temperature of the preheat air increases. This first level of response is, as mentioned above, intended to keep the $\Delta T$ below the selected "poor" performance target so that the combustor 12 will operate under an optimal performance level.

The controller 72, based on the ongoing detection of bed and freeboard temperatures, may initiate a second level of response if the first level of response is deemed by the controller 72 to be inadequate. This may involve, for example, regulation of the dewatering equipment/chemical conditioning feed system. This is reflected in FIG. 3 in centrifuge 14 and polymer supply 22. Thus, the controller 72 can regulate selected components such as the polymer feed rate, centrifuge torque or the like depending on the type of the dewatering technology used in a particular application. Also, the system can control the mass flow to combustor 12. This can be achieved by direct measurement of flow and percentage of total solids in the cake feed line 26 from centrifuge 14. This can also be achieved indirectly by calculation through monitoring the sludge flow by detector 48 to centrifuge 14 and the flow/solids content of centrate line 24. A further refinement of control can be based on the calorific value of the sludge and how that effects the $\Delta T$.

A third level of response may automatically be initiated in the event that the controller 72 detects that the second level of response is inadequate and that "poor" performance is still indicated. The third level of response may include regulating the sludge feed rate and/or blend ratio of sludges from influent sources to control the mass flow of solids loading to combustor 12.

If that level of response is deemed inadequate by controller 72, a fourth level of response may be initiated. This may include regulation of the feed of auxiliary fuel such as natural gas or fuel oil to supplement the wastewater solids fuel source. This is a less preferred level of response and is only engaged under the most rigorous conditions. A final level of response may include activating quench water sprays in accordance with conventional technology. This fifth level of response is also to be avoided if possible and might occur under the most rigorous conditions.

It is further possible to add additional measures to various of the levels of responses prior to the fourth level or fifth level mentioned above and/or to switch measures between response levels. For example, it is possible to monitor the oxygen content of the off gas. The minimum content of oxygen in the off gas flowing through off gas line 36 should be a minimum of about 2%. If excess oxygen is present, then it is possible to increase the rate of solids feed from the centrifuge 14 to combustor 12 to increase throughput. Also, as the oxygen content approaches the 2% minimum setpoint, it is possible to increase the fluidizing air flow rate (to a maximum level of about 10% increase) at which point if the oxygen content continues to drop, then the solids feed to the combustor may be reduced and/or discontinued. This level of response also not only improves throughput, but also helps manage emissions.

Another possibility is to monitor the windbox temperature with sensor 60. This monitoring may be used to regulate the maximum air temperature on the discharge side of heat exchanger 16. If it exceeds a maximum setpoint temperature, then it may be necessary to reduce and/or shut down the sludge feed to combustor 12.

EXAMPLE 1

Sewage Sludge Too High in Water Content

This considers a typical case illustrated in FIG. 2 whereby regular fluctuations in the wastewater solids feed stream are the result of poorly controlled polymer dosage. The downstream effect produces wide swings in the FBC bed and freeboard temperatures. The example is: At time $t_o$, the solids content in the sewage sludge is decreasing, resulting in a feed that is higher in water content and, therefore, increases evaporation within the incinerator bed, thereby causing the bed temperature to drop. The resulting effect, a phenomenon known as "over-bed burning", is that more volatile solids burn in the freeboard, causing freeboard temperature to rise. The net effect is an increasing ΔT, which is undesirable.

In our systems, the increasing ΔT and decreasing bed temperature are detected and such detection activates a signal from the controller to increase the polymer dosage applied at the upstream dewatering operation, thereby increasing the solids content of the sewage sludge feed. This avoids the need for auxiliary fuel addition which is otherwise undesirable since it increases the operating cost. If freeboard temperature continues to rise and reaches a selected set point, a second set of signals is generated to regulate (decrease) the feed rate of the sewage sludge pump, thereby preventing activation of the quench water sprays. Thus, the controller allows for regulation of polymer dosage at the dewatering stage to maintain maximum throughput and steady operations within the FBC.

EXAMPLE 2

Sewage Sludge Too High in Solids Content

This considers a typical case illustrated in FIG. 2 whereby regular fluctuations in the wastewater solids feed stream are the result of poorly controlled centrifuge operations. The downstream effect produces wide swings in the FBC bed and freeboard temperatures. The example is: At time $t_2$, solids content in the sewage sludge is increasing, thereby resulting in more organic volatiles to be burned within the bed, causing the bed temperature to rise. If the sludge solids content continues to increase, the ΔT will be lower as freeboard temperature decreases and bed temperature rises. The net effect is a decreasing ΔT, which is good, but an increasing bed temperature, which may be too high.

In our system, a decreasing ΔT and increasing bed temperature approaching the upper bed temperature setpoint are detected and such detection activates a signal from the controller to further open the cold-air bypass valve to lower the air temperature to the system. In the case where this valve is already fully open, a control signal may be sent to decrease the applied torque on the upstream centrifuge operations, thereby reducing the solids content within the sewage sludge feed to the FBC. If freeboard temperature continues to fall and reaches a selected (minimum) set point, a second set of signals generated to regulate (increase) the feed rate of the variable speed sewage sludge pump, thereby improving the performance of the sludge incineration system.

Selected benefits of our systems and methods include:

Maximized throughput—the improved consistency of wastewater sludge quality, specifically less variability in percentage of water content, results in greater stability of freeboard temperature ultimately reducing the cycling frequency and duration of operation for the roof sprays which results in an increase in average capacity of the FBC.

Reduced operational costs—the improved consistency of wastewater sludge quality allows for reduced use of auxiliary fuel sources.

Improved emissions—the improved consistency of wastewater sludge feed yields a more stable FBC operating environment thereby enhancing emissions quality.

A variety of modifications to the structures and methods described will be apparent to those skilled in the art from the disclosure provided herein. Thus, the disclosure may be embodied in other specific forms without departing from the spirit or essential attributes thereof and, accordingly, reference should be made to the appended claims, rather than to the foregoing specification, as indicating the scope of the disclosure.

What is claimed is:

1. A method of controlling mass and heat loading of sludge feed in a fluidized bed combustor (FBC) that receives sludge and/or a polymer dosage from dewatering equipment located upstream of the FBC, the method comprising:

continuously measuring at least one performance characteristic of the FBC and producing an input signal characteristic based on the measured at least one performance characteristic;

analyzing the input signal and determining a rate of change of the at least one performance characteristic;

determining a desired operating limit of the rate of change;

determining a point of transition between the addition of polymer to the dewatering equipment and the addition of sludge in order to maintain the rate of change proximate to the desired operating limit;

generating a first output signal based on the rate of change and the determined transition point to control addition of polymer to the dewatering equipment; and generating a second output signal based on the rate of change and the determined transition point to control addition of sludge feed to the FBC.

2. The method of claim 1, wherein the performance characteristic is the difference between freeboard and bed temperatures ΔT.

3. The method of claim 1, further comprising regulating operation of a centrifuge to provide a selected sludge quality.

4. The method of claim 1, further comprising regulating at least one selected from the group consisting of operation a of a belt press via adjustment of belt speed or tension plate and frame press, screw press, vacuum press and a dryer to provide a selected wastewater solids quality.

5. The method of claim 1, wherein mass flow of solids to the FBC is regulated by blending influent sludge streams to control the ratio of primary and secondary sludge blends to a selected dry solids concentration based upon combustor performance.

6. The method of claim 1, further comprising a suspended solids sensor selected from the group consisting of optical, microwave, ultrasound, vibrational frequency and zeta potential sensors that detect the moisture content of the sludge prior to entering the FBC.

* * * * *

UNITED STATES PATENT AND TRADEMARK OFFICE

CERTIFICATE OF CORRECTION

PATENT NO. : 8,291,842 B2
APPLICATION NO. : 12/838929
DATED : October 23, 2012
INVENTOR(S) : Dangtran et al.

It is certified that error appears in the above-identified patent and that said Letters Patent is hereby corrected as shown below:

Column 1, Line 59: The letter "A" should read --Δ--.

Column 4, Line 15: The letter "A" should read --Δ--.

Column 4, Line 17: The letter "A" should read --Δ--.

Column 4, Line 60: The term "of" should read --off--.

Column 4, Line 61: The term "of" should read --off--.

Column 6, Line 1: The "," should be deleted.

Claim 4, Column 9, Lines 4-6: "operation a of a belt press via adjustment of belt speed or tension plate and frame press, screw press, vacuum press and a dryer to provide" should read --operation of a belt press via adjustment of belt speed or tension plate and frame press, screw press, and a vacuum press to provide--.

Signed and Sealed this
Eighth Day of January, 2013

David J. Kappos

David J. Kappos
*Director of the United States Patent and Trademark Office*